US006706979B1

(12) United States Patent
Chou

(10) Patent No.: US 6,706,979 B1
(45) Date of Patent: Mar. 16, 2004

(54) VIBRATION SWITCH

(76) Inventor: Tien-Ming Chou, No. 41, San-Hsi 5th St., Pei Dist., Taichung City (TW)

( * ) Notice: Subject to any disclaimer, the term of this patent is extended or adjusted under 35 U.S.C. 154(b) by 0 days.

(21) Appl. No.: 10/436,867

(22) Filed: May 13, 2003

(51) Int. Cl.[7] ..... H01H 35/14
(52) U.S. Cl. ..... 200/61.45 R; 200/61.52; 200/277
(58) Field of Search ..... 200/61.45 R–61.53, 200/276, 277, DIG. 29

(56) References Cited

U.S. PATENT DOCUMENTS 2,107,570 A * 2/1938 Hobbs ..... 362/61.52
2,206,094 A * 7/1940 Hobbs ..... 362/496
3,706,867 A * 12/1972 Rand et al. ..... 200/61.52
4,085,304 A * 4/1978 Hasler ..... 200/61.45 R
4,513,183 A * 4/1985 Hill ..... 200/61.45 R
5,209,343 A * 5/1993 Romano et al. ..... 200/61.52
6,545,235 B1 * 4/2003 Chou ..... 200/61.51

FOREIGN PATENT DOCUMENTS

GB 2077504 A * 12/1981 ..... H01H/35/14

* cited by examiner

*Primary Examiner*—James R. Scott
(74) *Attorney, Agent, or Firm*—Frommer Lawrence & Haug LLP; Ronald R. Santucci

(57) ABSTRACT

A vibration switch includes a housing with an accommodation chamber for receiving securely two electric contact bodies therein. The electric contact bodies are spaced apart from each other, and respectively have rolling surfaces, each of which defines a farthermost area and a tangential area. Two electrically conductive rollable bodies are respectively rollable on the rolling surfaces such that the rollable bodies respectively abut against the tangential areas by virtue of gravity to establish electric contact between the electric contact bodies. Once the housing is caused to quiver, the rollable bodies will lurch towards one of the farthermost areas so that one of the rollable bodies is out of contact with one of the rolling surfaces, thereby breaking the electric contact between the electric contact bodies.

10 Claims, 12 Drawing Sheets

VIBRATION SWITCH

BACKGROUND OF THE INVENTION

1. Field of the Invention

This invention relates to a vibration switch, more particularly to a vibration switch with two electrically conductive rollable bodies which abut against two tangential areas of two electric contact bodies to establish electric contact between the electric contact bodies, and which will lurch towards a farthermost area of a respective one of the electric contact bodies when the vibration switch is in an unsteady state so as to break the electric contact.

2. Description of the Related Art

Referring to FIGS. 1 and 2, a conventional vibration switch 1 is shown to include a metal housing 11 with an accommodation chamber 111 for receiving a deflectable electric contact body 12, such as a coil spring. An anchoring end 121 of the electric contact body 12 is sleeved on a plug portion 112 of the housing 11 such that a contact terminal end 122 thereof is held along an axis. A first electric contact terminal 113 extends from a side wall of the housing 11 downwardly. A second electric terminal 14 has a contact end inserted into the contact terminal end 122 through a through hole 131 in an insulating plug member 13.

As shown in FIG. 3, when the housing 11 is jerked by a force (F), the contact terminal end 122 of the electric contact body 12 is deflected radially as a result of an inertial force so as to contact the second electric terminal 14, thereby establishing an electrical connection between the first and second electric contact terminals 113,14. However, when the housing 11 is jerked by a force (not shown) from a direction substantially parallel to the axis, the extent of deflection of the contact terminal end 122 is relatively small so that the contact terminal end 122 may not be able to contact the second electric terminal 14 to establish the electrical connection between the terminals 113,14.

SUMMARY OF THE INVENTION

The object of the present invention is to provide a vibration switch which can be instantly disposed in a switch-off state when jerked by a force coming from any direction.

According to this invention, the vibration switch is adapted to be disposed in electric contact with a support, and includes a housing adapted to be mounted on the support in an upright direction. The housing includes an upper wall and a lower wall spaced apart from each other in the upright direction to confine an accommodation chamber.

First and second electric contact bodies are disposed in the accommodation chamber, and respectively have first and second rolling surfaces that are spaced apart from each other along a centerline which is oriented in one of the upright direction and a longitudinal direction that is transverse to the upright direction. The first and second rolling surfaces respectively define first and second farthermost areas which are spaced apart from each other by a first length along the centerline, and respectively define first and second tangential areas which are offset from the centerline. The first and second tangential areas are spaced apart from each other by a distance that, when projected on a longitudinal line in the longitudinal direction, is equivalent to a second length.

First and second electrically conductive rollable bodies are respectively rollable on the first and second rolling surfaces about first and second rolling axes, and respectively have first and second perimetrical areas which are in contact with the first and second rolling surfaces, and first and second widths. Each of the first and second widths is defined by a distance which is between two diametrically opposite points in a respective one of the first and second perimetrical areas. Sum of the first width and the second width is smaller than the first length and larger than the sum of the second length and the third length. As such, when the support on which the housing is mounted stands still, the first and second electrically conductive rollable bodies are tangent to each other, and respectively abut against the first and second tangential areas by virtue of gravity, thereby establishing electric contact between the first and second electric contact bodies. Once the support is caused to quiver in an unsteady state, the first and second electrically conductive rollable bodies will be caused to lurch towards one of the first and second farthermost areas so that one of the first and second electrically conductive rollable bodies is out of contact with a corresponding one of the first and second rolling surfaces which defines the other one of said first and second farthermost areas, thereby breaking the electric contact between the first and second electric contact bodies.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
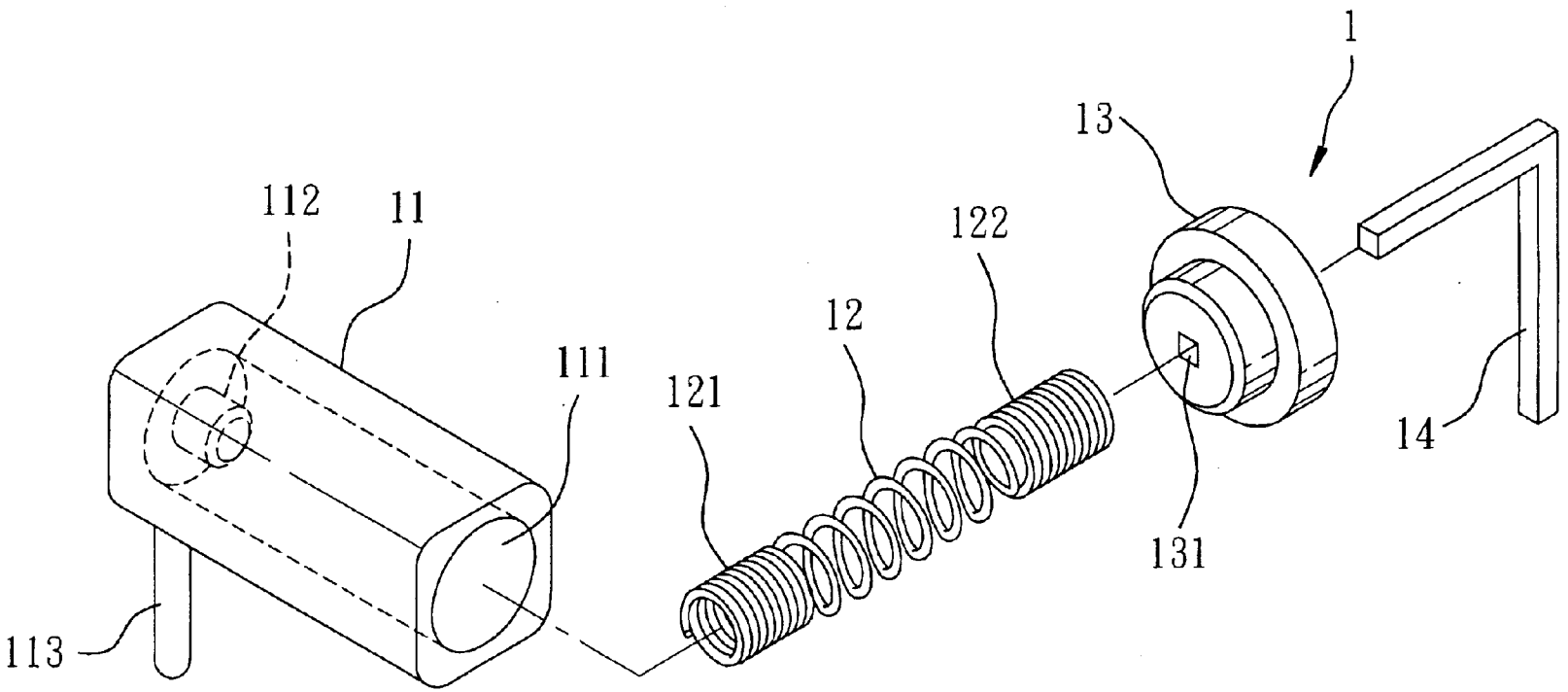
FIG. 1 PRIOR ART
FIG. 1 is an exploded perspective view of a conventional vibration switch.

Before the present invention is described in greater detail, it should be noted that same reference numerals have been used to denote like elements throughout the specification.

Figure 4:
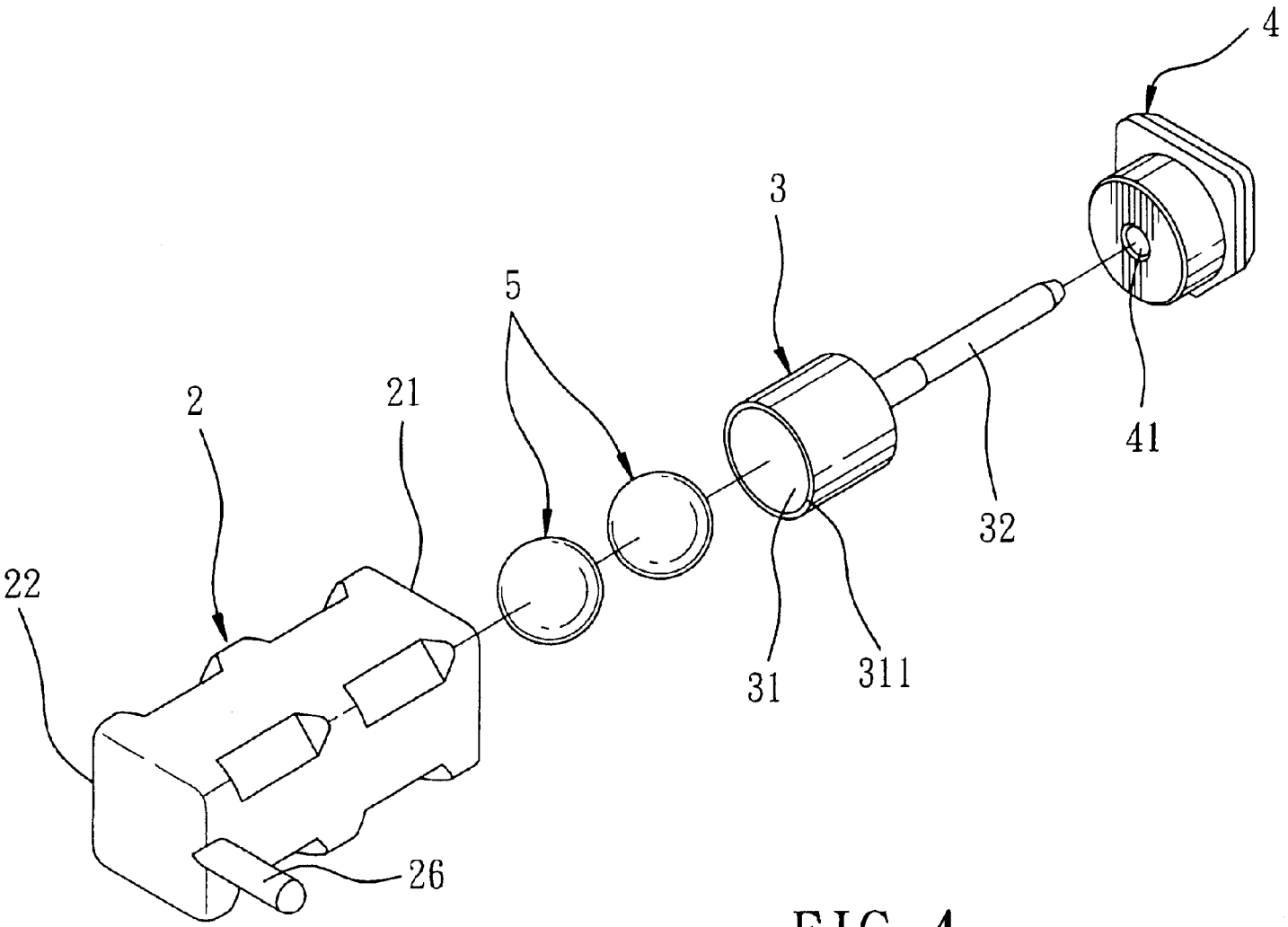
FIG. 4 is an exploded perspective view of the first preferred embodiment of a vibration switch according to this invention.
Figure 5:
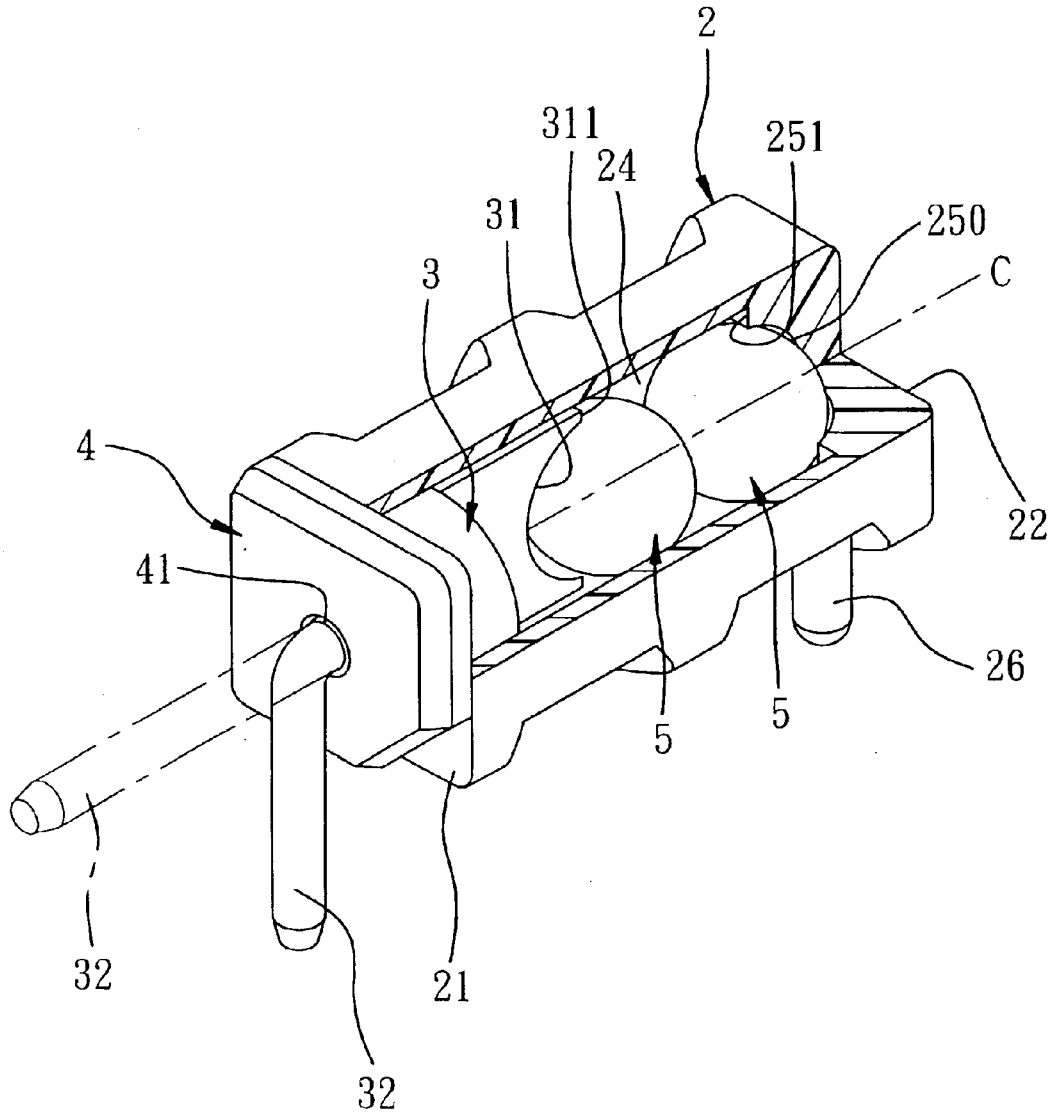
FIG. 5 is a fragmentary perspective view of the first preferred embodiment.
Figure 6:
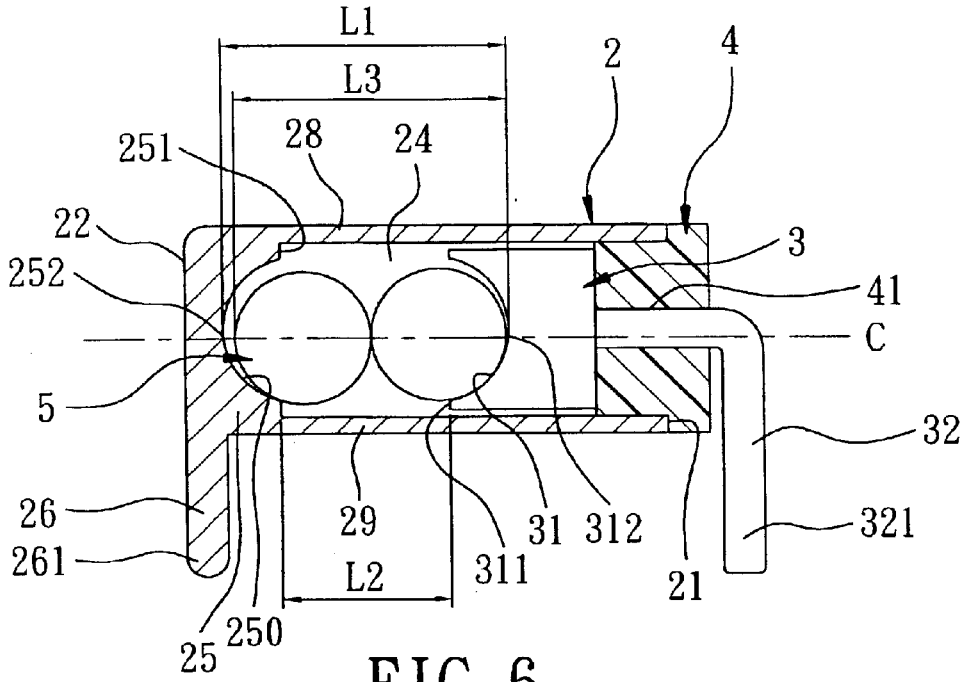
FIGS. 6 and 7 are sectional views of the first preferred embodiment in switch-on and switch-off states, respectively.

Referring to FIGS. 4 to 6, the first preferred embodiment of a vibration switch according to the present invention is shown to comprise a housing 2, first and second electric contact bodies 25,3, first and second electrically conductive rollable bodies 5, and first and second electric terminals 26,32.

The housing 2 is made from an electrically conductive material, and is adapted to be mounted on a support (not shown), such as a circuit board, in an upright direction. The housing 2 has an upper wall 28 and a lower wall 29 spaced apart from each other in the upright direction, a left end portion 22 which is integrally formed with the upper and lower walls 28,29, and a right end portion which is configured as an insulating plug 4 that is fitted into an opening end 21 cooperatively defined by the upper and lower walls 28,29, thereby confining an accommodation chamber 24. The insulating plug 4 has a through hole 41 formed therethrough in a longitudinal direction transverse to the upright direction.

The first electric contact body 25 is integrally formed with the left end portion 22, and is disposed in the accommodation chamber 24. The first electric contact body 25 has a first rolling surface 250 which defines a first farthermost area 252 that is disposed proximate to the left endportion 22, and a first tangential area 251 that is offset from a centerline (C) oriented in the longitudinal direction and that extends to surround the centerline (C) so as to form a first surrounding region. The first rolling surface 250 is configured to be convergent from the first surrounding region to the first farthermost area 252. In this embodiment, the first rolling surface 250 is hemispherical.

The second electric contact body 3 is disposed in the accommodation chamber 24, and has a second rolling surface 31 which confronts and which is spaced apart from the first rolling surface 250 along the centerline (C). The second rolling surface 31 defines a second farthermost area 312 which is disposed proximate to the insulating plug 4 and which is spaced apart from the first farthermost area 252 by a first length (L1) along the centerline (C), and a second tangential area 311 which is offset from the centerline (C) and which extends to surround the centerline (C) so as to form a second surrounding region. The second rolling surface 31 is configured to be convergent from the second surrounding region to the second farthermost area 312. In this embodiment, the second rolling surface 31 is hemispherical. Moreover, the first and second surrounding regions of the first and second rolling surfaces 250,31 are spaced apart from each other by a distance which, when projected on a longitudinal line (i.e. the centerline (C)) in the longitudinal direction, is equivalent to a second length (L2).

The first and second electrically conductive rollable bodies 5 are spherical in shape, are disposed to be rollable on the first and second rolling surfaces 250,31 about first and second rolling axes, respectively, and respectively have first and second perimetrical areas. The first and second electrically conductive rollable bodies 5 have first and second widths, respectively, each of which is defined by a distance between two diametrically opposite points in a respective one of the first and second perimetrical areas. In this embodiment, the first and second widths are equal to diameters of the first and second electrically conductive rollable bodies 5, respectively. Sum (L3) of the first width and the second width is smaller than the first length (L1) and larger than the second length (L2).

The first electric terminal 26 is integrally formed with the left end portion 22 of the housing 2, and has a connected end connected to the first electric contact body 25, and a terminal end 261 extending from the connected end outwardly and downwardly of the left end portion 22 to be in electric contact with the support.

The second electric terminal 32 has a connected end connected to the second electric contact body 3 and extending through the through hole 41 in the insulating plug 4, and a terminal end 321 that extends from the connected end in the longitudinal direction and outwardly of the insulating plug 4 and that is bent downwardly of the housing 1 to be in electric contact with the support.

As such, when the support (not shown) on which the housing 1 is mounted stands still, the first and second electrically conductive rollable bodies 5, which are tangent to each other, respectively abut against the first and second tangential areas 251,311 by virtue of gravity, thereby establishing an electric contact between the first and second electric contact bodies 25,3 and making an electrical connection between the first and second electric terminals 26,32, as shown in FIG. 6.

Figure 7:
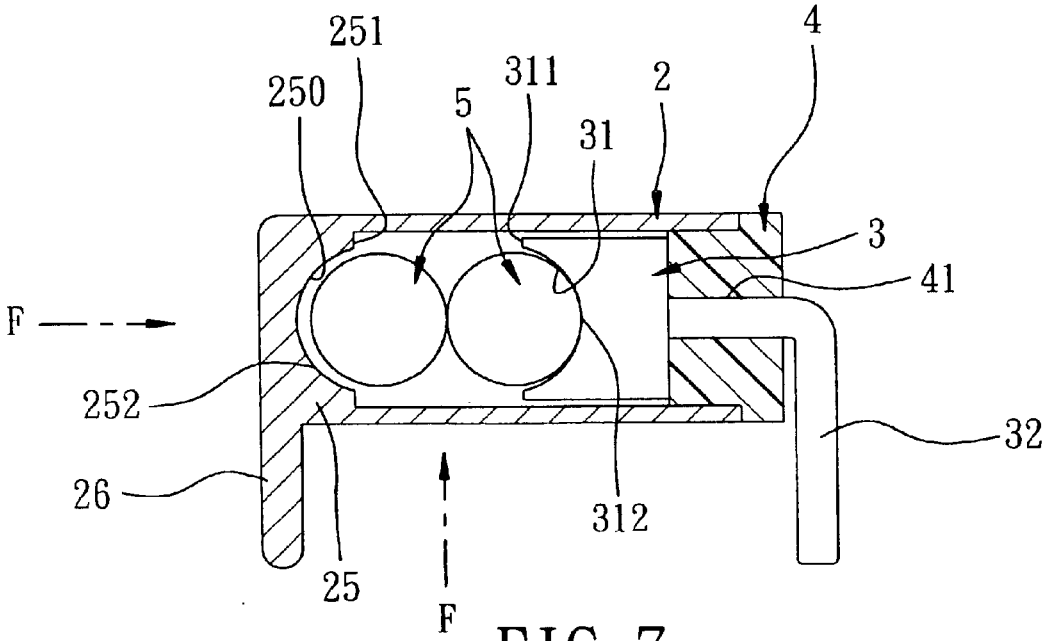

Referring to FIG. 7, once the support is caused to quiver in an unsteady state by a force (F), the first and second electrically conductive rollable bodies 5 will be caused to lurch towards one of the first and second farthermost areas 252,312 (the second farthermost area 312 as shown in FIG. 7) so that one of the first and second electrically conductive rollable bodies 5 is out of contact with a corresponding one of the first and second rolling surfaces 250,31 (the first rolling surface 250 as shown in FIG. 7) that defines the other one of the first and second farthermost areas 252,312, thereby breaking the electric contact between the first and second electric contact bodies 25,3, and the electrical connection between the first and second electric terminals 26,32.

Figure 2:
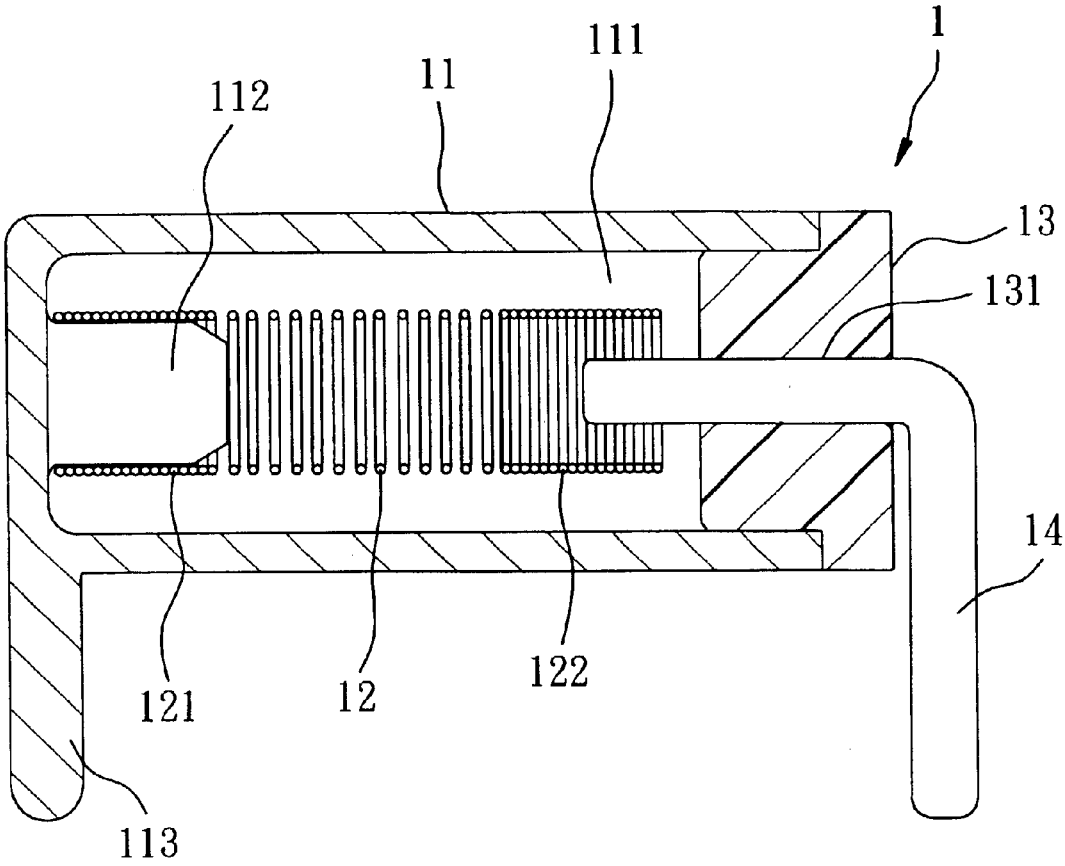
FIG. 2 PRIOR ART
FIGS. 2 and 3 are sectional views of the conventional vibration switch in switch-off and switch-on states, respectively.
Figure 3:
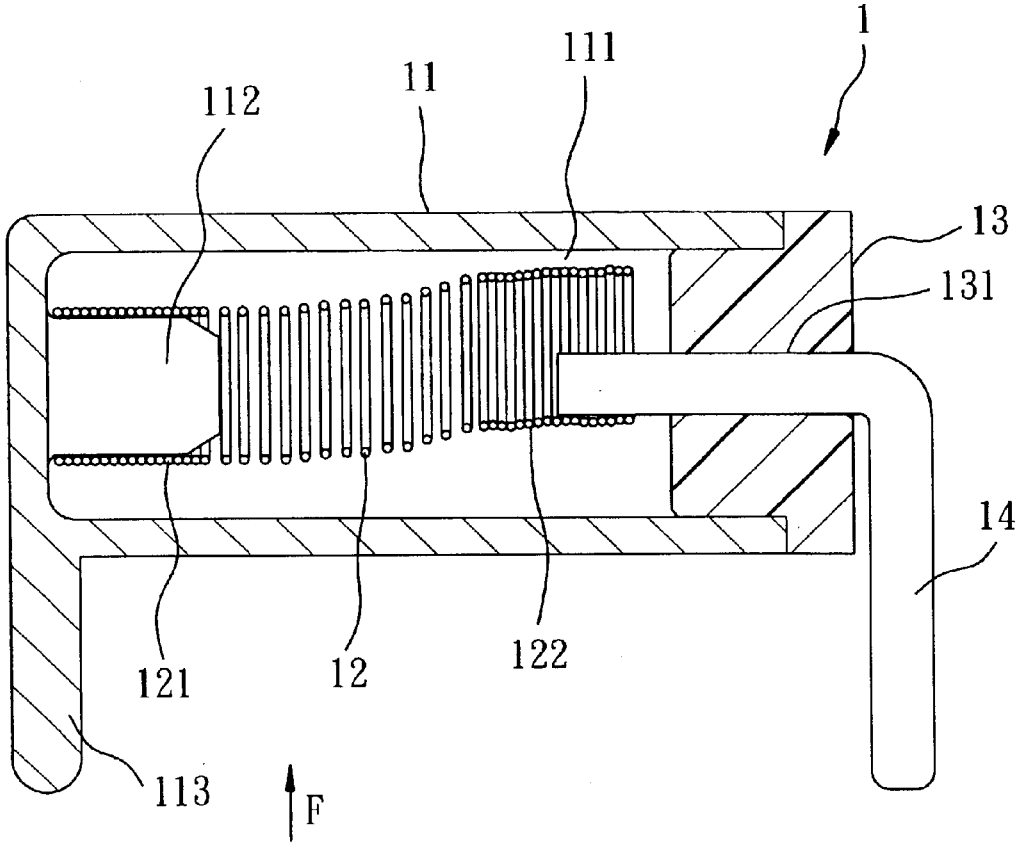
FIG. 3 PRIOR ART

As compared with the conventional vibration switch shown in FIGS. 1 to 3, the vibration switch of this invention has enhanced sensitivity and can be instantly disposed in a switch-off state when jerked by a force coming from any direction.

Figure 8:
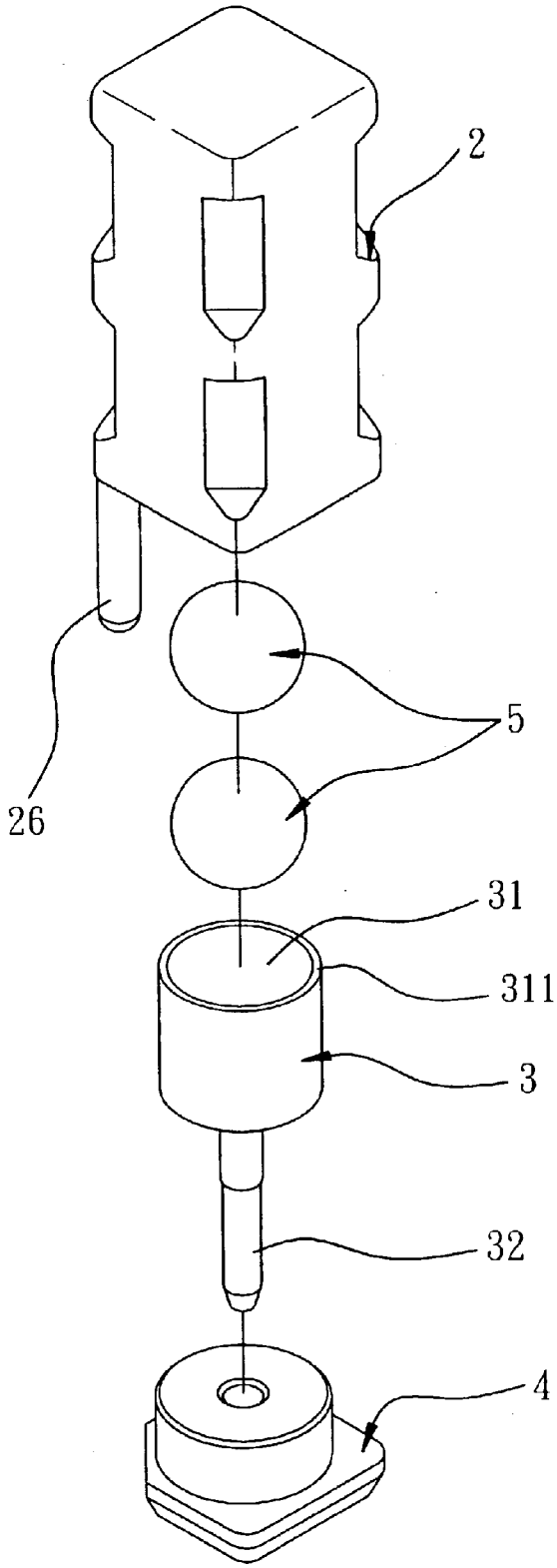
FIG. 8 is an exploded perspective view of the second preferred embodiment of a vibration switch according to this invention.
Figure 9:
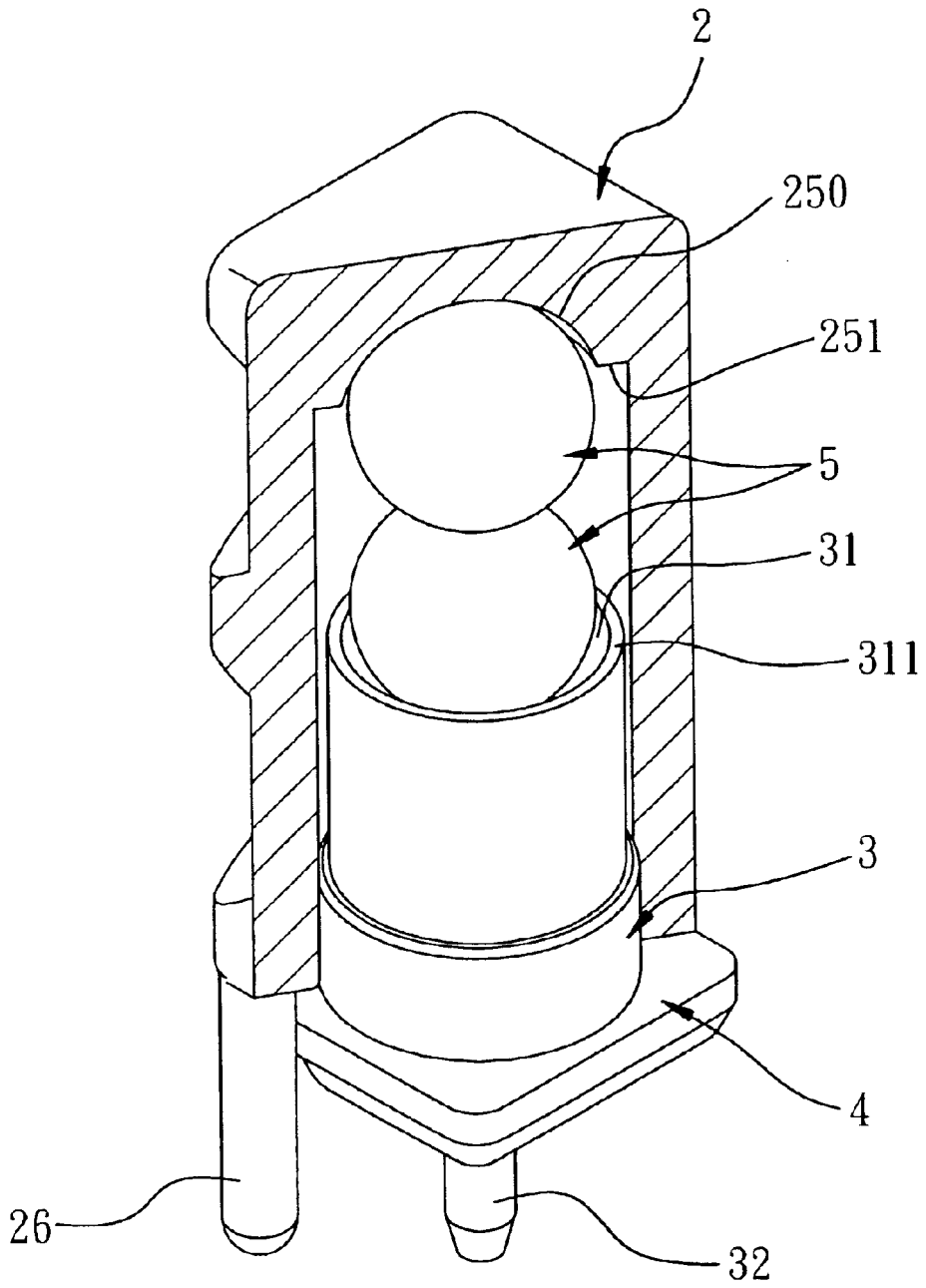
FIG. 9 is a fragmentary perspective view of the second preferred embodiment.
Figure 10:
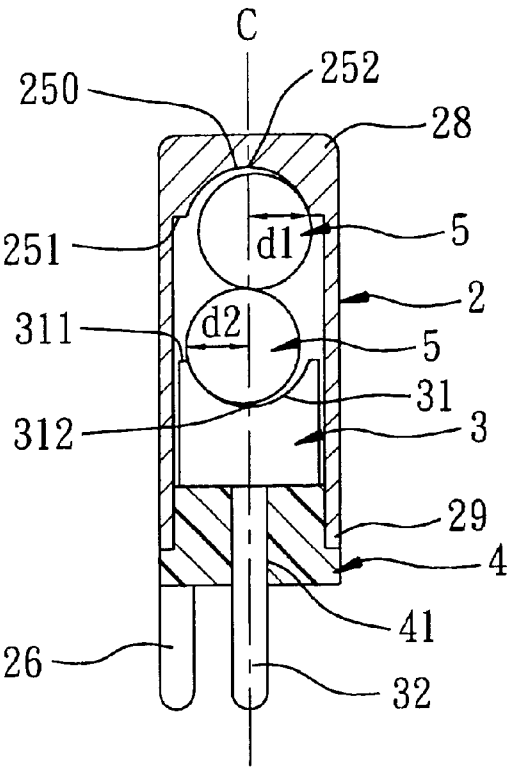

Referring to FIGS. 8 to 10, the second preferred embodiment of a vibration switch according to this invention is shown to be similar to the first preferred embodiment in construction. In this embodiment, the first and second rolling surfaces 250,31 are spaced apart from each other along a centerline (C) which is oriented in the upright direction. That is, the first and second rolling surfaces 250,31 are disposed inwardly of the upper and lower walls 28,29 of the housing 2, respectively, and confront each other in the upright direction. Thus, the first and second farthermost areas 252, 312 are disposed proximate to the upper and lower walls 28,29, respectively.

It is noted that the second length (L2) is the sum of a first distance (d1) between the first tangential area 251 and the centerline (C) in terms of the longitudinal direction, and a second distance (d2) between the second tangential area 311 and the centerline (C) in terms of the longitudinal direction. As described in the first preferred embodiment, the third length (L3) is larger that the second length (L2) so as to maintain the contact between the first and second electrically conductive rollable bodies 5 and the first and second tangential areas 252,312, respectively.

Furthermore, an insulating plug 4 is fitted into an opening end confined by the lower wall 29 to insulate the lower wall 29 from the second electric contact body 3. The first electric terminal 26 is integrally formed with the housing 2, and has a terminal end which extends outwardly and downwardly of the lower wall 29.

Figure 11:
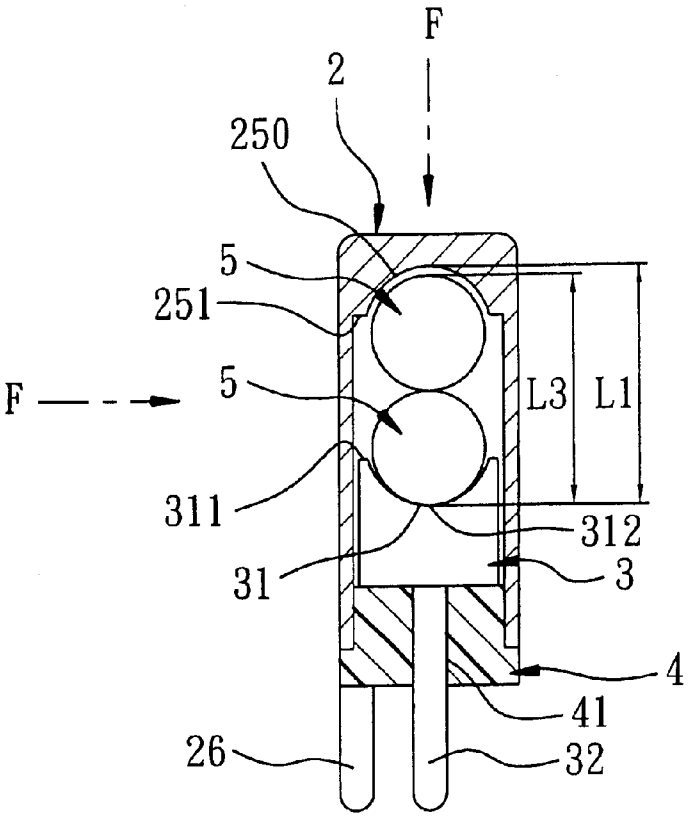
FIGS. 10 and 11 are sectional views of the second preferred embodiment in switch-on and switch-off states, respectively.

As such, referring to FIG. 11, once the support (not shown), on which the housing 2 is mounted, is caused to quiver by a force (F), the second electrically conductive rollable body 5, which is disposed on the second rolling surface 31, is caused to lurch towards the second farthermost area 312 such that the first electrically conductive rollable body 5 is out of contact with the first rolling surface 250, thereby breaking the electrical connection between the first and second electric terminals 26,32.

Figure 12:
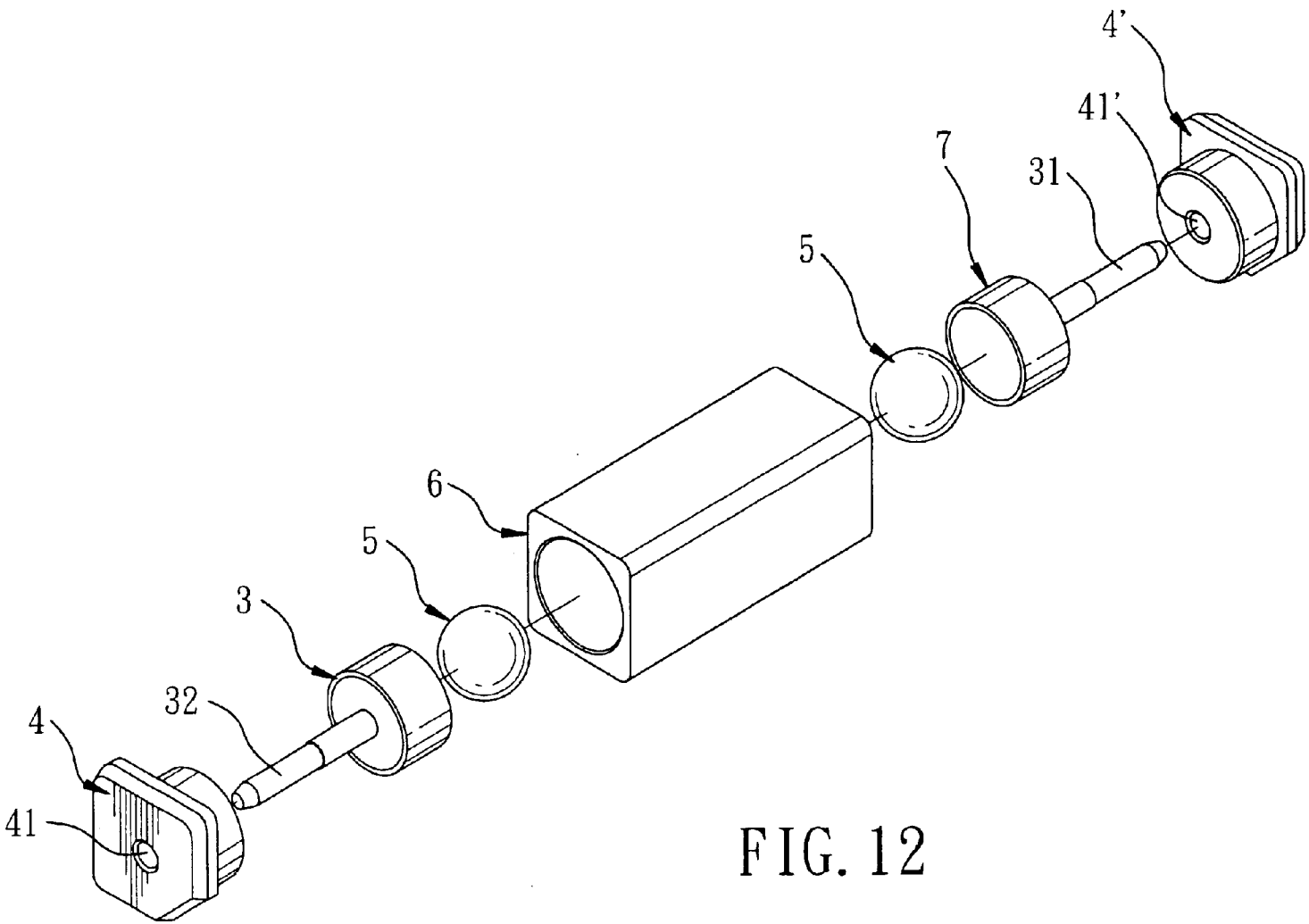
FIG. 12 is an exploded perspective view of the third preferred embodiment of a vibration switch according to this invention.
Figure 13:
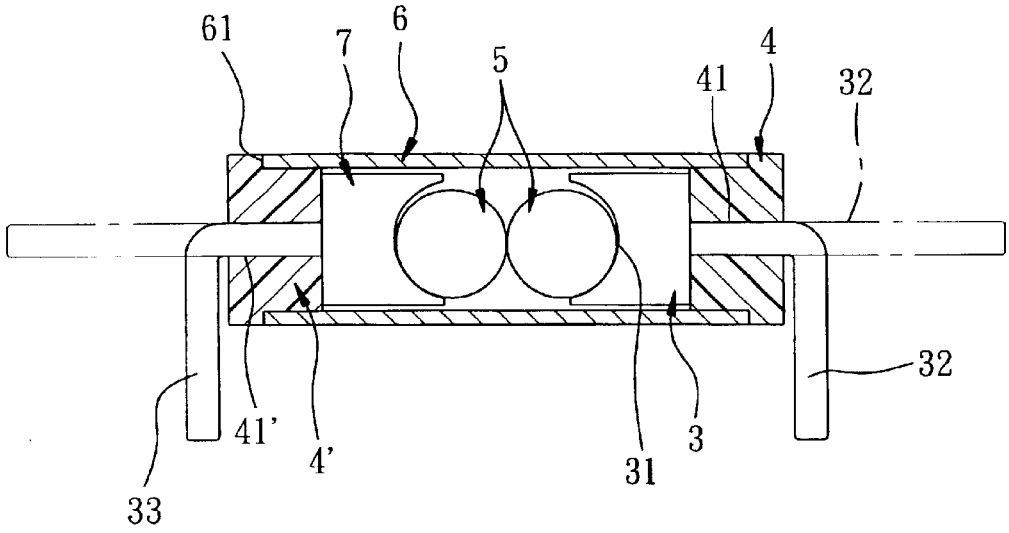
FIGS. 13 and 14 are sectional views of the third preferred embodiment in switch-on and switch-off states, respectively.
Figure 14:
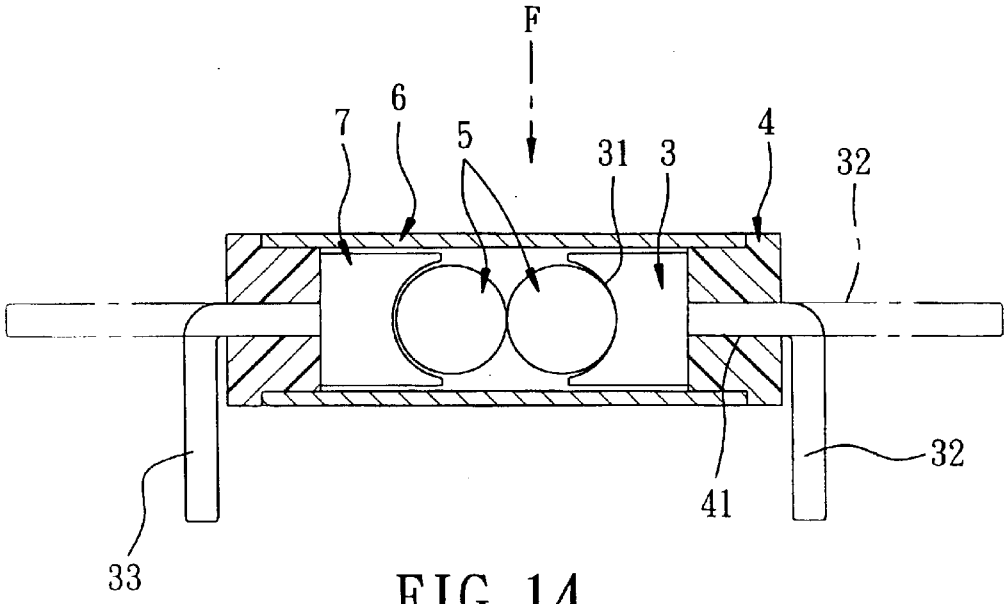

Referring to FIGS. 12 to 14, the third preferred embodiment of a vibration switch according to this invention is shown to be similar to the first preferred embodiment in construction. In this embodiment, the first electric contact body 7 is configured to be similar to the second electric contact body 3, and is separable from the housing 6. An additional insulating plug 4' is provided to be fitted into an opening end 61 of the housing 6 to serve as the left end portion. Furthermore, the first electric terminal 33 is configured to be similar to the second electric terminal 32, and has a connected end connected to the second electric contact body 7 through a through hole 41' in the insulating plug 4', and a terminal end that extends from the connected end in the longitudinal direction and outwardly of the insulating plug 4 and bent downwardly of the housing 6 to be in electric contact with the support (not shown).

Figure 16:
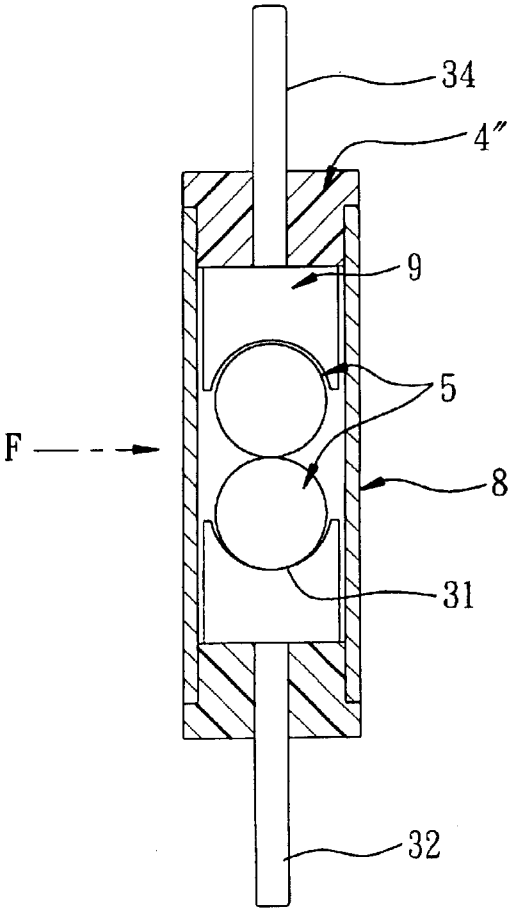
FIGS. 15 and 16 are sectional views of the fourth preferred embodiment of a vibration switch according to this invention in switch-on and switch-off states, respectively.
Figure 15:
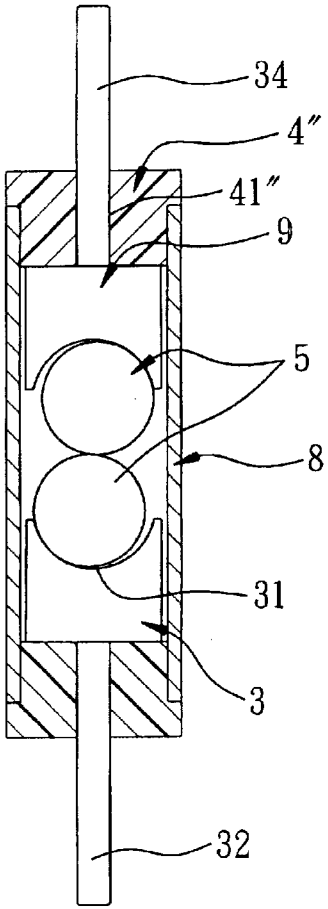

FIGS. 15 and 16 show the fourth preferred embodiment of a vibration switch according to this invention. This embodiment is similar to the second preferred embodiment, except that the first electric contact body 9 is configured to be similar to the second electric contact body 3, and is separable from the housing 8. An additional insulating plug 4" is provided to be fitted into an opening end of the housing 8. Furthermore, the first electric terminal 34 is similar to the second electric terminal 32, and has a connected end connected to the second electric contact body 9 through a through hole 41" in the insulating plug 4", and a terminal end extending from the connected end in the upright direction and outwardly of the insulating plug 4".

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A vibration switch adapted to be in electric contact with a support, comprising:

a housing adapted to be mounted on the support in an upright direction, and including an upper wall and a lower wall spaced apart from each other in the upright direction to confine an accommodation chamber;

first and second electric contact bodies which are disposed in said accommodation chamber, and which respectively have first and second rolling surfaces that are spaced apart from each other along a centerline oriented in one of the upright direction and a longitudinal direction that is transverse to the upright direction, said first and second rolling surfaces respectively defining first and second farthermost areas which are spaced apart from each other by a first length along the centerline, and respectively defining first and second tangential areas which are offset from the centerline, said first and second tangential areas being spaced apart from each other by a distance that, when projected on a longitudinal line in the longitudinal direction, is equivalent to a second length; and first and second electrically conductive rollable bodies which are rollable on said first and second rolling surfaces about first and second rolling axes, respectively, and which respectively have first and second perimetrical areas that are in contact with the first and second rolling surfaces, respectively, and first and second widths, each of said first and second widths being defined by a distance that is between two diametrically opposite points in a respective one of said first and second perimetrical areas, sum of the first width and the second width being smaller than the first length and larger than the second length, such that when the support on which said housing is mounted stands still, said first and second electrically conductive rollable bodies are tangent to each other, and respectively abut against said first and second tangential areas by virtue of gravity to thereby establish electric contact between said first and second electric contact bodies, and such that once the support is caused to quiver in an unsteady state, said first and second electrically conductive rollable bodies will be caused to lurch towards one of said first and second farthermost areas so that one of said first and second electrically conductive rollable bodies is out of contact with a corresponding one of said first and second rolling surfaces which defines the other one of said first and second farthermost areas, thereby breaking the electric contact between said first and second electric contact bodies.

2. The vibration switch according to claim 1, wherein said first and second electrically conductive rollable bodies are spherical in shape, and the first and second widths are equal to diameters of said first and second electrically conductive rollable bodies, respectively.

3. The vibration switch according to claim 2, wherein said first and second tangential areas extend to surround the centerline so as to form first and second surrounding regions, respectively, and each of said first and second rolling surfaces is configured to be convergent from a respective one of said first and second surrounding regions to a respective one of said first and second farthermost areas.

4. The vibration switch according to claim 1, wherein the centerline is oriented in the longitudinal direction such that said first and second rolling surfaces confront each other in the longitudinal direction.

5. The vibration switch according to claim 4, wherein said housing further has left and right end portions interconnecting said upper wall and said lower wall to confine said accommodation chamber, said first and second farthermost areas being disposed proximate to said left and right end portions, respectively.

6. The vibration switch according to claim 5, wherein said right end portion is insulated from said second electric contact body, said vibration switch further comprising first and second electric terminals, each of which includes a connected end that is connected to a respective one of said first and second electric contact bodies, and a terminal end that extends from said connected end in the longitudinal direction and outwardly and downwardly of a respective one of said left and right end portions of said housing.

7. The vibration switch according to claim 6, wherein said housing is made from an electrically conductive material, and said first electric contact body and said first electric terminal are integrally formed with said housing.

8. The vibration switch according to claim 1, wherein the centerline is oriented in the upright direction such that said first and second rolling surfaces are disposed inwardly of said upper wall and said lower wall, respectively, and confront each other in the upright direction, said first and second farthermost areas being disposed proximate to said upper wall and said lower walls, respectively.

9. The vibration switch according to claim 8, wherein said lower wall is insulated from said second electric contact body, said vibration switch further comprising first and second electric terminals, each of which includes a connected end that is connected to a respective one of said first and second electric contact bodies, and a terminal end that extends from said connected end in the upright direction, said terminal end of said first electric terminal being disposed to extend outwardly and downwardly of said lower wall of said housing.

10. The vibration switch according to claim 9, wherein said housing is made from an electrically conductive material, and said first electric contact body and said first electric terminal are integrally formed with said housing.

* * * * *